US006416630B1

(12) United States Patent
Matuschczyk et al.

(10) Patent No.: US 6,416,630 B1
(45) Date of Patent: Jul. 9, 2002

(54) PRESS JACKET AND METHOD FOR TREATING A MATERIAL WEB

(75) Inventors: Uwe Matuschczyk, Geislingen; Andreas Endters, Herbrechtingen, both of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/299,012

(22) Filed: Apr. 26, 1999

(30) Foreign Application Priority Data

Apr. 30, 1998 (DE) ..... 198 19 526

(51) Int. Cl.[7] ..... D21F 3/00; B65G 15/34; B65G 17/00; B32B 3/28

(52) U.S. Cl. ..... 162/358.4; 462/901; 1987/847; 1987/844.1; 428/179; 428/182

(58) Field of Search ..... 162/358.4, 901; 198/847, 844.1; 428/179, 182

(56) References Cited

U.S. PATENT DOCUMENTS 4,113,556 A 9/1978 Kankaanpää
5,543,015 A 8/1996 Jermo
6,004,429 A 12/1999 Schiel ..... 162/111

FOREIGN PATENT DOCUMENTS

| | | |
|---|---|---|
| DE | 276833 | 7/1914 |
| DE | 4340724 | 6/1995 |
| EP | 0241389 | 10/1987 |
| FR | 2348316 | 11/1977 |
| GB | 1050823 | 12/1966 |

*Primary Examiner*—Stanley S. Silverman
*Assistant Examiner*—Dionne A. Walls
(74) *Attorney, Agent, or Firm*—Greenblum & Bernstein P.L.C.

(57) ABSTRACT

The present invention provides a press jacket of a press device and a method for treating a material web, in particular a paper or cardboard web, in a nip, where the press jacket has an outer circumferential surface that is provided with grooves and/or blind bores. The grooves and/or bores include a side wall having an the opening region with a bevel and/or a rounded section that extends along a curved line, in order to counteract a volume reduction that occurs when the press device is loaded.

44 Claims, 2 Drawing Sheets

PRESS JACKET AND METHOD FOR TREATING A MATERIAL WEB

CROSS-REFERENCE TO RELATED APPLICATION

The present invention claims the priority under 35 U.S.C. § 119 of German Application No. 198 19 526.5 filed Apr. 30, 1998, the disclosure of which is expressly incorporated by reference herein in its entirety.

BACKGROUND INFORMATION

1. Field of the Invention

The invention relates to a press jacket of a press device, with grooves and/or blind bores provided in the outer circumferential surface, for treating a material web, in particular a paper or cardboard web, in a nip.

2. Discussion of Background Information

Press jackets of this type are used, for example, with press devices where a flexible press jacket that revolves around a rigid support is pressed against, in particular, a rigid opposing surface. A material web, which may be a paper web or a cardboard web, is guided through a nip formed between the flexible press jacket and the opposing surface. Due to the flexibility of the press jacket, it also can be used with other press devices, such as a jacket of a shoe press unit in an extended nip press.

In order to reduce the hydraulic pressure in the nip, as well as to improve drainage, press jackets are partially provided with grooves and/or blind bores that are intended to provide additional water storage volume, which is maintained as constant as possible during operation. The groove width usually lies within a range from 0.5 to 1.5 mm, and the preferred groove width is 1.0 mm. The depth of the parallel side walls of such grooves usually lies within a range from 0.5 to 2.0 mm, and the preferred depth is 1.0 mm. A portion of the grooves may have a conical shape, with an angle of 5° to 15°. A press jacket of this type has been disclosed, for example, by U.S. Pat. No. 5,543,015. Moreover, the blind bores usually have a diameter in the range from 1.6 to 2.8 mm, where the preferred diameter is 2.2 mm. Blind bores of this kind usually have a depth in the range from 1.5 to 2.5 mm, where the preferred depth is 2.0 mm. As a rule, these blind bores are cylindrically formed.

Due to the high degree of stress in the nip, as well as the flow properties of the elastomeric materials that are used for such press jackets, the grooves or blind bores are "pressed shut" during operation, such that a cross-sectional reduction takes place, particularly in the opening region of the groove and/or blind bore. Consequently, the available storage volume during operation is considerably reduced in relation to the original storage volume that existed in the new state and in the absence of stress. Hence, the advantage sought with the grooves or the blind bores, of an increased drainage capacity in the nip by means of the additional storage volume, is at least partially nullified. For example, experience during actual use has shown that the grooves of the press jacket disclosed in U.S. Pat. No. 5,543,015, which extend conically at an angle of 5° to 15°, have resulted in practically no improvements during operation, at least thus far.

SUMMARY OF THE INVENTION

The present invention provides a press jacket of a press device, with grooves and/or blind bores provided in its outer circumferential surface, for treating a material web in a nip which, despite the relatively high press loads and the flow properties of the elastomeric materials usually used with such press jackets, maintains as large a storage volume as possible during operation.

The present invention provides a press jacket having grooves and/or blind bores, whose side walls in the opening region are provided with a bevel and/or have a rounded section that extends along a curved line, such that the grooves and/or blind bores counteract the above-mentioned volume reduction that occurs when a conventional press is loaded.

According to the present invention, the volume reduction that occurs with each press loading is counteracted because in the critical opening region of each groove or bore, a bevel, or a rounded section that extends along a curved line, is provided which completely or at least partially compensates for the "pressing shut" of the grooves or of the blind bores. The form and positioning of the grooves and/or bores disclosed for this purpose relate to a press jacket in its new state.

The edge length of the opening region bevel, measured in the direction of the groove or bore depth, is preferably approximately 1 to 3 times, and preferably approximately 2 times, the edge length measured in the longitudinal direction, perpendicular to the direction of groove or bore depth. In particular, the edge length of the bevel measured in the longitudinal direction may be in the range of approximately 0.1 mm to 0.3 mm, and preferably is approximately 0.2 mm.

Corresponding measurements also may be provided for a rounded opening region section that extends along a curved line. In this instance, these measurements relate to a tangent resting against the rounded section.

For instance, according to an embodiment of the invention, the edge length of the rounded section—measured in the direction of the groove or bore depth, preferably with reference to a tangent resting against the rounded section—is approximately 1 to 3 times, and preferably is approximately 2 times, the edge length measured in the longitudinal direction, again with reference to the tangent. Further, the edge length of the rounded section—measured in the longitudinal direction, preferably with reference to the tangent resting against the rounded section—can lie within a range from approximately 0.1 mm to approximately 0.3 mm, and preferably is approximately 0.2 mm.

The edge length of the bevel or the rounded section, measured in the direction of the groove or bore depth, may be formed such that a cylindrical wall section remains positioned between the bottom of the respective groove or blind bore, and the bevel or rounded section.

The rounded section can extend along a curved line that corresponds, or at least essentially corresponds, to an arc or to an involuted curve.

According to another press jacket embodiment of the invention, the bevel or the rounded section is disposed immediately adjacent the outer edge of the respective groove or blind bore.

According to yet another embodiment, the bevel or rounded section is offset inwardly, and at a specific distance, from to the outer edge of the respective groove or blind bore, in the direction of the groove or bore depth.

In the case of a groove in the press jacket, preferably at least the side walls of the groove that extend in the circumference direction of the press jacket are provided with a bevel or rounded section.

The side wall of each blind bore is preferably provided with an annular bevel, or a rounded section, that extends over the entire inner circumference.

The present invention provides a press jacket for a press device for treating a material web in a nip which includes an outer circumferential surface, where the outer circumferential surface includes a groove or a blind bore, where the groove blind bore has a side wall in an opening region, and where the side wall has a bevel or a rounded section that extends along a curved line, such that the bevel and rounded section counteracts a reduction in volume in the groove or blind bore when the press device is loaded. The material web may be a paper web or a cardboard web. Further, a depth edge length of the bevel measured in the direction of groove or bore depth may be approximately 1 to 3 times a longitudinal edge length measured in a longitudinal direction. The depth edge length preferably is approximately 2 times the longitudinal edge length. Further, a longitudinal edge length of the bevel measured in the longitudinal direction may be between approximately 0.1 mm and approximately 0.3 mm, and preferably is approximately 0.2 mm.

According to another aspect of the present invention, a depth edge length of the rounded section measured in the direction of the groove or bore depth may be approximately 1 to 3 times a longitudinal edge length measured in a longitudinal direction, and preferably is approximately 2 times the longitudinal edge length. The depth edge length and the longitudinal edge length may be determined with reference to a tangent that rests against the rounded section. Moreover, a longitudinal edge length of the rounded section measured in a longitudinal direction may be between approximately 0.1 mm and approximately 0.3 mm, and preferably is approximately 0.2 mm. The longitudinal edge length may be determined with reference to a tangent that rests against the rounded section.

According to yet another aspect of the invention, the press jacket may include a cylindrical wall section that is disposed between the bevel or the rounded section, and the bottom of the groove or the blind bore. The side wall's rounded section may extend along a curved line that substantially corresponds to an arc. Alternatively, the rounded section may extend along a curved line that substantially corresponds to an involuted curve.

The groove or blind bore of the press jacket of the present invention may have an outer edge, and the bevel or the rounded section may be positioned on the outer edge. The bevel or the rounded section may be positioned offset in the direction of groove or bore depth, and at a distance, from the outer edge. Moreover, the side wall of the groove may extend in a circumferential direction of the press jacket, and the side wall may include the bevel or the rounded section. Alternatively, the side wall of the blind bore may include the bevel or the rounded section, and the bevel or the rounded section may extend over the entire inner circumferential surface of the side wall. Further, the bevel may be an annular bevel. Moreover, the press device may be a shoe press unit, and the nip may be an extended nip.

The present invention also includes a method for improving the drainage of water from a material web by: providing a flexible press jacket, forming a nip between the flexible press jacket and a rigid opposing surface, transporting the web through the nip, and applying a press load to the web in the nip, where the flexible press jacket includes an outer circumferential surface, where the outer circumferential surface includes a groove or a blind bore having a side wall in an opening region, and where the side wall has a bevel or a rounded section that extends along a curved line. The material web may be a paper web or a cardboard web. Moreover, a depth edge length of the bevel measured in the direction of the groove or bore depth may be approximately 1 to 3 times, and preferably is 2 times, a longitudinal edge length measured in a longitudinal direction. Further, a longitudinal edge length of the bevel measured in a longitudinal direction may be between approximately 0.1 mm and approximately 0.3 mm.

According to another aspect of the present inventive method, a depth edge length of the rounded section, measured in a direction of the groove or bore depth, may be approximately 1 to 3 times a longitudinal edge length measured in a longitudinal direction. Preferably, the depth edge length and the longitudinal edge length are determined with reference to a tangent that rests against the rounded section. Moreover, a longitudinal edge length of the rounded section measured in a longitudinal direction may be between approximately 0.1 mm and approximately 0.3 mm. The longitudinal edge length preferably is determined with reference to a tangent that rests against the rounded section.

According to yet another aspect of the invention, the press jacket may include a cylindrical wall section disposed between the bevel or the rounded section, and the bottom of the groove or the blind bore. The rounded section may extend along a curved line that substantially corresponds to an arc. Alternatively, the rounded section extends along a curved line that substantially corresponds to an involuted curve. Moreover, the groove or the blind bore may have an outer edge, and the bevel or the rounded section may be positioned on the outer edge. Further, the bevel or the rounded section may be positioned offset in a direction of the groove or the bore depth, and at a distance from the outer edge. The side wall of the groove may extend in a circumferential direction of the press jacket, and the side wall may include the bevel or the rounded section. Similarly, the side wall of the blind bore may include the bevel or the rounded section, and the bevel or the rounded section may extend over an entire inner circumferential surface of the side wall. Further, according to the improved method for draining a web, the press device may be a shoe press unit, and the nip may be an extended nip.

Further, the aforementioned and following characteristic features of the present invention can be used not only in the described combinations, but also in other combinations or alone, without departing from the scope of the invention. Further embodiments and advantages can be seen from the detailed description and the accompanying Figures.

BRIEF DESCRIPTION OF THE DRAWINGS

The present invention is further described in the detailed description which follows, in reference to the noted drawings by way of non-limiting examples of preferred embodiments of the present invention, wherein the same reference numerals represent similar parts throughout the drawings, and wherein.

DETAILED DESCRIPTION OF THE INVENTION

Figure 1:
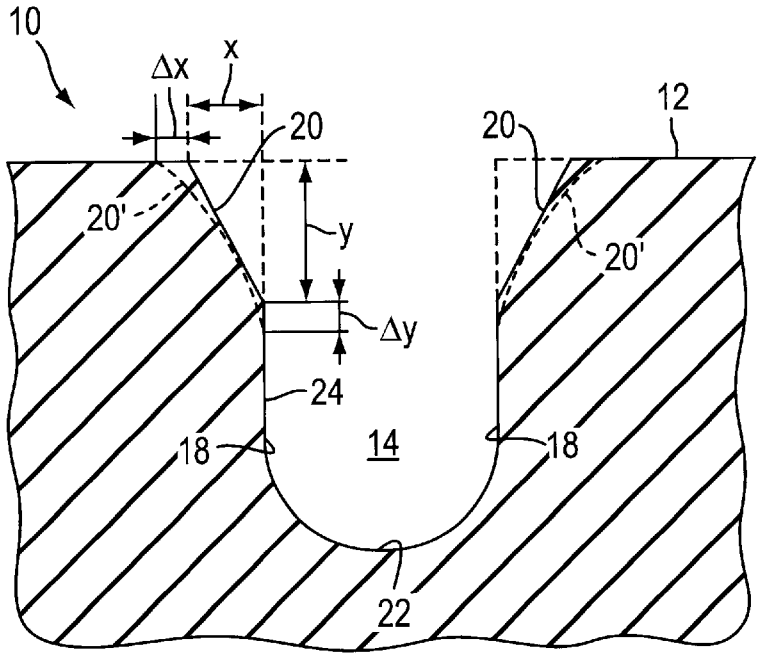
FIG. 1 illustrates an embodiment of a press jacket having a groove which is provided with two bevels on its outer edge, disposed on opposite sides from each other.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing making apparent to those skilled in the art how the several forms of the invention may be embodied in practice.

FIGS. 1 to 4 illustrate schematic, sectional partial depictions of a press jacket 10 that can be used with a press device for treating a material web in a nip. The material web, in particular, can be a paper web or cardboard web.

A large number of grooves 14 and/or blind bores 16 may be provided in the outer circumferential surface 12 of the press jacket.

The side walls 18 of grooves 14 (see FIGS. 1 and 3) and blind bores 16 (see FIGS. 2 and 4) are each provided with a bevel 20, in order to counteract the volume reduction that occurs when the press is loaded.

In lieu of bevel 20 shown with a solid line, a rounded section 20', which extends along a curved line, can also be provided. Rounded sections 20' of this kind are depicted in FIGS. 1 and 2 with dashed lines.

Figure 2:
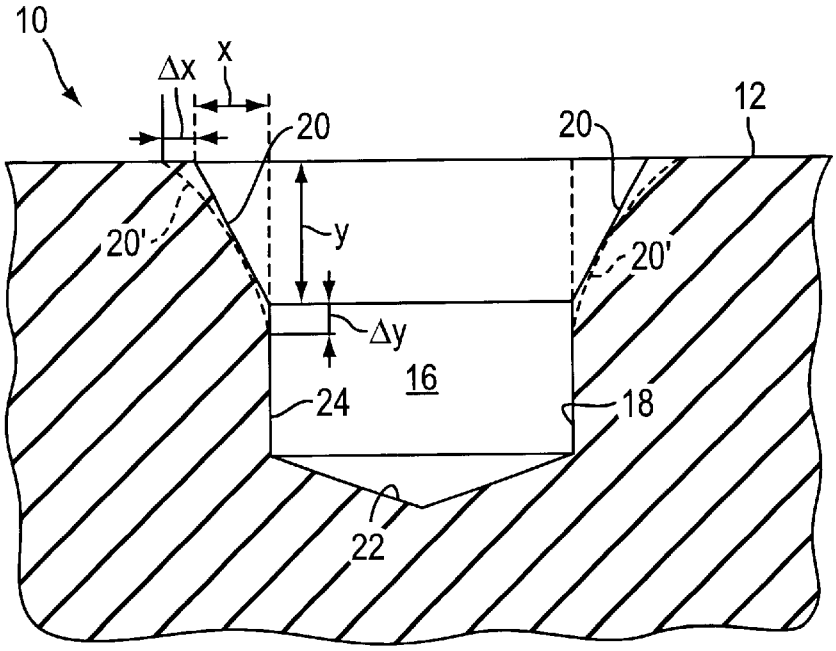
FIG. 2 illustrates an embodiment of a press jacket having a blind bore which is provided with a continuous bevel on its outer edge.
Figure 3:
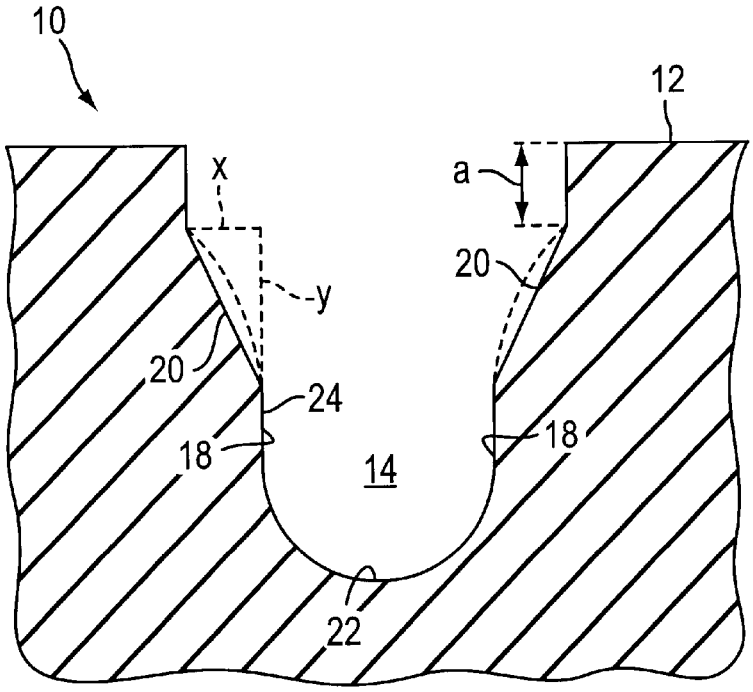
FIG. 3 illustrates another embodiment of a press jacket having a groove, with bevels that are offset inwardly in relation to the outer edge of the press jacket.

In the exemplary embodiments, the edge length y of bevel 20—measured in the direction of the groove or bore depth (see FIGS. 1 to 3)—is approximately 1 to 3 times, and preferably approximately 2 times, the edge length x measured in the longitudinal direction (see FIGS. 1 to 3). Edge length x of the bevel, measured in the longitudinal direction, lies within a range from approximately 0.1 mm to approximately 0.3 mm, and preferably is approximately 0.2 mm.

The rounded sections 20', which can be provided in lieu of bevels 20, have comparable edge lengths x and y, which preferably are measured in relation to a tangent line that rests against the rounded section 20', and which extend in the plane of the respectively replaced bevel 20 (see FIGS. 1 and 2). With respect to rounded sections 20', dimensions $\Delta x$ and $\Delta y$ represent the additional lengths of the rounded surfaces, beyond lengths x and y measured in relation to the tangent line, in the longitudinal direction and in the groove or bore depth direction, respectively (see FIGS. 1 and 2). The lengths of dimensions $\Delta x$ and $\Delta y$ of rounded sections 20' have the same relationship as the edge lengths x and y, such that $\Delta x:\Delta y=x:y$.

In the exemplary embodiments of press jacket 10 that are shown in FIGS. 1 to 4, edge length y—measured in the direction of groove or bore depth (see FIGS. 1 to 3)—of a respective bevel 20 or rounded section 20', is formed such that a cylindrical wall section 24 remains disposed between the bottom 22 of a respective groove 14 or blind bore 16, and the bevel 20 or the rounded section 20'.

The rounded sections 20' indicated with dashed lines in FIGS. 1 and 2, for example, can extend along a curved line that substantially corresponds to an arc, or at least substantially corresponds to an involute curve.

In the embodiments of FIGS. 1 and 2, bevels 20 or rounded sections 20' are disposed directly at the outer edge of the relevant groove 14 (see FIG. 1) or blind bore 16 (see FIG. 2) that defines the opening region. In these embodiments, the edge length y of a respective bevel 20 or rounded section 20'—measured in the direction of the groove or bore depth—is slightly greater than the depth of the cylindrical wall section 24 adjoining the bottom 22.

Figure 4:
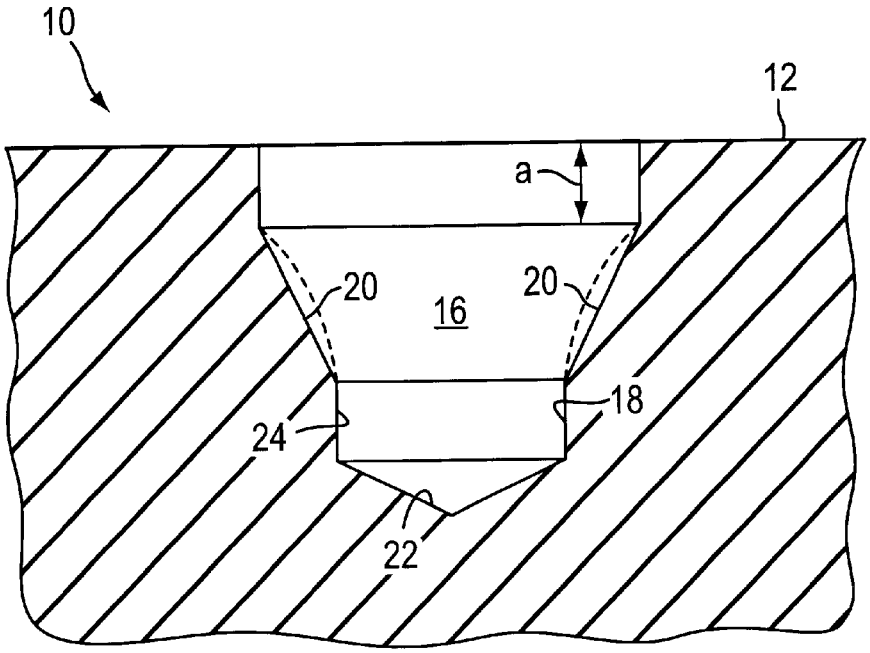
FIG. 4 illustrates another embodiment of a press jacket having a blind bore, with a bevel that is offset inwardly in relation to the outer edge of the press jacket.

In contrast, in the embodiments of FIGS. 3 and 4, bevels 20 or rounded sections 20' are offset inwardly, in the direction of the groove or bore depth, with regard to the outer edge of groove 14 (see FIG. 3) or blind bore 16 (see FIG. 4) that defines the opening region, and are formed at a distance a from this outer edge.

As illustrated in FIGS. 1 and 3, bottom 22 of groove 14 is formed with a semicircular cross-section.

According to FIGS. 1 and 3, each side wall 18 of groove 14 that extends in the circumferential direction of the press jacket is provided with a bevel 20 or a rounded section 20'.

In blind bores 16 illustrated in FIGS. 2 and 4, side wall 18 is provided with an annular bevel 20 or a rounded section 20' that extends over the entire inner circumference.

As illustrated in FIGS. 3 and 4, edge length y of bevel 20—measured in the direction of the groove or bore depth—is both greater than the distance "a" of this bevel from the outer edge of the press jacket, and is greater than the depth of the cylindrical wall section 24 provided between bottom 22 and bevel 20.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular materials and embodiments, the invention is not intended to be limited to the particulars disclosed herein; rather, the invention extends to a functionally equivalent structures, methods and uses, such as are within the scope of the appended claims.

REFERENCE LIST

10 press jacket
12 outer circumference surface
14 grooves
16 blind bore
18 side walls
20 bevel
20' rounded section
22 bottom
24 cylindrical wall section
a offset distance

What is claimed is:

1. A press jacket for a press device for treating a material web in a nip, comprising:

an outer circumferential surface including at least one opening;

the at least one opening comprising one of a groove and a blind bore;

the at least one opening including a bottom section which is rounded, a wall section which is one of a parallel wall section and a cylindrical wall section, and an inwardly sloping section which is one of a beveled section and a rounded section;

the inwardly sloping section being arranged between the outer circumferential surface and the wall section; and a depth edge length of the inwardly sloping section measured in a direction of the at least one opening being approximately 1 to 3 times a longitudinal edge length measured in a longitudinal direction, wherein the inwardly sloping section counteracts a volume reduction of the at least one opening when the press device is loaded.

2. The press jacket according to claim 1, wherein the material web comprising one of a paper web and a cardboard web.

3. The press jacket of claim 1, wherein the depth edge length is approximately 2 times the longitudinal edge length.

4. The press jacket according to claim 1, wherein a longitudinal edge length of the inwardly sloping section measured in a longitudinal direction is between approximately 0.1 mm and approximately 0.3 mm.

5. The press jacket of claim 4, wherein the longitudinal edge length is approximately 0.2 mm.

6. A method for improving the drainage of water from a material web, comprising:

providing a flexible press jacket;

forming a nip between the flexible press jacket and a rigid opposing surface;

transporting the material web through the nip;

applying a press load to the web in the nip;

the flexible press jacket including an outer circumferential surface;

an outer circumferential surface including at least one opening;

the at least one opening comprising one of a groove and a blind bore;

the at least one opening including a bottom section which is rounded, a wall section which is one of a parallel wall section and a cylindrical wall section, and an inwardly sloping section which is one of a beveled section and a rounded section;

the inwardly sloping section being arranged between the outer circumferential surface and the wall section; and a depth edge length of the inwardly sloping section measured in a direction of the at least one opening being approximately 1 to 3 times a longitudinal edge length measured in a longitudinal direction, wherein the inwardly sloping section counteracts a volume reduction of the at least one opening when the press device is loaded.

7. The method of claim 6, wherein the material web comprising one of a paper web and a cardboard web.

8. The method of claim 6, wherein the depth length is approximately 2 times the longitudinal edge length.

9. The method of claim 6, wherein a longitudinal edge length of the inwardly sloping section measured in a longitudinal direction is between approximately 0.1 mm and approximately 0.3 mm.

10. The method of claim 9, wherein the longitudinal edge length is approximately 0.2 mm.

11. The press jacket for a press device for treating a material web in a nip, comprising:

an outer circumferential surface including at least one opening;

the at least one opening one of a groove and a blind bore;

the at least one opening including a bottom section which is pointed, a wall section which is one of a parallel wall section and a cylindrical wall section, and an inwardly sloping section which is one of a beveled section and a rounded section;

the inwardly sloping section being arranged between the outer circumferential surface and the wall section; and a depth edge length of the inwardly sloping section measured in a direction of the at least one opening being approximately 1 to 3 times a longitudinal edge length measured in a longitudinal direction, wherein the inwardly sloping section counteracts a volume reduction of the at least one opening when the press device is loaded.

12. The press jacket of claim 11, wherein the material web comprising one of a paper web and a cardboard web.

13. The press jacket of claim 11, wherein the depth edge length is approximately 2 times the longitudinal edge length.

14. The press jacket of claim 11, wherein a longitudinal edge length of the inwardly sloping section measured in a longitudinal direction is between approximately 0.1 mm and approximately 0.3 mm.

15. The press jacket of claim 14, wherein the longitudinal edge length is approximately 0.2 mm.

16. A method for improving the drainage of water from a material web, comprising:

providing a flexible press jacket;

forming a nip between the flexible press jacket and rigid opposing surface;

transporting the material web through the nip;

applying a press load to the web in the nip;

the flexible press jacket including an outer circumferential surface;

an outer circumferential surface including at least one opening;

the at least one opening comprising one of a groove and a blind bore;

the at least one opening including a bottom section which is pointed, a wall section which is one of a parallel wall section and a cylindrical wall section, and an inwardly sloping section which is one of a beveled section and a rounded section;

the inwardly sloping section being arranged between the outer circumferential surface and the wall section; and a depth edge length of the inwardly sloping section measured in a direction of the at least one opening being approximately 1 to 3 times a longitudinal edge length measured in a longitudinal direction, wherein the inwardly sloping section counteracts a volume reduction of the at least one opening when the press device is loaded.

17. The method of claim 16, wherein the material web comprising one of a paper web and a cardboard web.

18. The method of claim 16, wherein the depth edge length is approximately 2 times the longitudinal edge length.

19. The method of claim 16, wherein a longitudinal edge length of the inwardly sloping section measured in a longitudinal direction is between approximately 0.1 mm and approximately 0.3 mm.

20. The method of claim 19, wherein the longitudinal edge length is approximately 0.2 mm.

21. A press jacket for a press device for treating a material web in a nip, comprising:

an outer circumferential surface including at least one opening;

the at least one opening comprising one of a groove and a blind bore;

the at least one opening including a bottom section which is one of rounded and pointed, a wall section which is one of a parallel wall section and a cylindrical wall section, and an inwardly sloping section which is one of a beveled section and a rounded section;

the inwardly sloping section being arranged offset in a direction of a depth of the at least one opening and at a distance from the outer circumferential surface;

wherein the inwardly sloping section counteracts a volume reduction of the at least one opening when the press device is loaded.

22. The press jacket of claim 21, wherein the material web comprising one of a paper web and a cardboard web.

23. The press jacket of claim 21, wherein a depth edge length of the inwardly sloping section measured in a direction of the at least one opening is approximately 1 to 3 times a longitudinal edge length measured in a longitudinal direction.

24. The press jacket of claim 23, wherein the depth length is approximately 2 times the longitudinal edge length.

25. The press jacket of claim 21, wherein a longitudinal edge length of the inwardly sloping section measured in a longitudinal direction is between approximately 0.1 mm and approximately 0.3 mm.

26. The press jacket of claim 25, wherein the longitudinal edge length is approximately 0.2 mm.

27. A method for improving the drainage of water from a material web, comprising:

providing a flexible press jacket;

forming a nip between the flexible press jacket and a rigid opposing surface;

transporting the material web in the nip;

applying a press load to the web in the nip;

the flexible press jacket including an outer circumferential surface;

the outer circumferential surface including at least one opening;

the at least one opening comprising one of a groove and a blind bore;

the at least one opening including a bottom section which is one of rounded and pointed, a wall section which is one of a parallel wall section and a cylindrical wall section, and an inwardly sloping section which is one of a beveled section and a rounded section;

the inwardly sloping section being arranged offset in a direction of a depth of the at least one opening and at a distance from the outer circumferential surface;

wherein the inwardly sloping section counteracts a volume reduction of the at least one opening when the press device is loaded.

28. The method of claim 27, wherein the material web comprising one of a paper web and a cardboard web.

29. The method of claim 27, wherein a depth edge length of the inwardly sloping section measured in a direction of the at least one opening is approximately 1 to 3 times a longitudinal edge length measured in a longitudinal direction.

30. The method of claim 29, wherein the depth edge length is approximately 2 times the longitudinal edge length.

31. The method of claim 27, wherein a longitudinal edge length of the inwardly sloping section measured in a longitudinal direction is between approximately 0.1 mm and approximately 0.3 mm.

32. The method of claim 31, wherein the longitudinal edge length is approximately 0.2 mm.

33. A press jacket for a press device for treating a material web in a nip, comprising:

an outer circumferential surface including at least one opening;

the at least one opening comprising one of a groove and a blind bore;

the at least one opening including a bottom section, an outer wall section, an inner wall section which is one of a parallel wall section and a cylindrical wall section, and an inwardly sloping section which is one of a beveled section and a rounded section;

the outer wall section defining an opening width which is greater than an opening width of the inner wall section;

the inwardly sloping section being arranged between the outer wall section and the inner wall section; and the inwardly sloping section being arranged offset in a direction of a depth of the at least one opening and at a distance from the outer circumferential surface, wherein the inwardly sloping section counteracts a volume reduction of the at least one opening when the press device is loaded.

34. The press jacket of claim 33, wherein the material web comprising one of a paper web and a cardboard web.

35. The press jacket of claim 33, wherein a depth edge length of the inwardly sloping section measured in a direction of the at least one opening is approximately 1 to 3 times a longitudinal edge length measured in a longitudinal direction.

36. The press jacket of claim 35, wherein the depth edge length is approximately 2 times the longitudinal edge length.

37. The press of claim 33, wherein a longitudinal edge length of the inwardly sloping section measured in a longitudinal direction is between approximately 0.1 mm and approximately 0.3 mm.

38. A press jacket of claim 37, wherein the longitudinal edge length is approximately 0.2 mm.

39. A method for improving the drainage of water from a material web, comprising:

providing a flexible press jacket;

forming a nip between the flexible press jacket and a rigid opposing surface;

transporting the material web through the nip;

applying a press load to the web in the nip;

the flexible press jacket including an outer circumferential surface;

an outer circumferential surface including at least one opening;

the at least one opening comprising one of a groove and a blind bore;

the at least one opening including a bottom section, an outer wall section, an inner wall section which is one of a parallel wall section and a cylindrical wall section, and an inwardly sloping section which is one of a beveled section and a rounded section the outer wall section defining an opening width which is greater than an opening width of the inner wall section;

the inwardly sloping section being arranged between the outer wall section and the inner wall section; and the inwardly sloping section being arranged offset in a direction of a depth of the at least one opening and at a distance from the outer circumferential surface;

wherein the inwardly sloping section counteracts a volume reduction of the at least one opening when the press device is loaded.

40. The method of claim 39, wherein the material web comprises one of a paper web and a cardboard web.

41. The method of claim 39, wherein a depth edge length of the inwardly sloping section measured in a direction of the at least one opening is approximately 1 to 3 times a longitudinal edge length measured in a longitudinal direction.

42. The method of claim 41, wherein the depth edge length is approximately 2 times the longitudinal edge length.

43. The method of claim 39, wherein a longitudinal edge length of the inwardly sloping section measured in a longitudinal direction is between approximately 0.1 mm and approximately 0.3 mm.

44. The method of claim 43, wherein the longitudinal edge length is approximately 0.2 mm.

* * * * *